United States Patent [19]

Okatsuka et al.

[11] Patent Number: 4,504,718

[45] Date of Patent: Mar. 12, 1985

[54] MICROWAVE HEATING APPARATUS WITH SOLID STATE MICROWAVE OSCILLATING DEVICE

[75] Inventors: Hisashi Okatsuka, Tokyo; Koichi Taniguchi, Inuyama; Mitsuo Konno, Yokohama; Ryuho Narita, Nagoya, all of Japan

[73] Assignee: Tokyo Shibaura Denki Kabushiki Kaisha, Kawasaki, Japan

[21] Appl. No.: 533,917

[22] Filed: Sep. 20, 1983

[30] Foreign Application Priority Data

Sep. 20, 1982 [JP] Japan ..... 57-163420
Sep. 20, 1982 [JP] Japan ..... 57-163421

[51] Int. Cl.[3] ..... H05B 6/66

[52] U.S. Cl. ..... 219/10.55 B; 219/10.55 R; 331/107 R; 330/297

[58] Field of Search ..... 219/10.55 B, 10.55 R; 331/107 R, 107 G, 185, 186; 330/297, 298, 199, 200

[56] References Cited

U.S. PATENT DOCUMENTS 3,557,333 1/1971 McAvoy ..... 219/10.55 B
3,591,826 7/1971 Valles ..... 219/10.55 B
3,691,338 9/1972 Chang ..... 219/10.55 B
3,867,607 2/1975 Ohtani ..... 219/10.55 B
4,079,333 3/1978 Yamada ..... 330/297
4,097,708 6/1978 Bickel ..... 219/10.55 R

FOREIGN PATENT DOCUMENTS 85110 8/1983 European Pat. Off. .
2558589 7/1977 Fed. Rep. of Germany .
50-45354 4/1975 Japan .
50-45355 4/1975 Japan .
50-136744 10/1975 Japan .
55-32312 8/1980 Japan .

*Primary Examiner*—P. H. Leung
*Attorney, Agent, or Firm*—Cushman, Darby & Cushman

[57] ABSTRACT

A microwave heating apparatus comprises a solid state oscillating circuit, a pre-amplifier module for amplifying the output of the oscillating circuit, a plurality of amplifier modules for amplifying the output of the pre-amplifier module, a first power supply source for energizing the solid state oscillating circuit and a second power supply source for energizing all of the amplifier modules. Such an apparatus further comprises a delay circuit for activating the first power supply source after the second power supply source has been activated and the amplifier modules have been in a stable state.

7 Claims, 5 Drawing Figures

MICROWAVE HEATING APPARATUS WITH SOLID STATE MICROWAVE OSCILLATING DEVICE

BACKGROUND OF THE INVENTION

The present invention relates to a microwave heating apparatus and, more particularly, to a microwave heating apparatus employing a solid state oscillating device.

Conventional microwave heating apparatuses have a magnetron as a microwave energy source. High tension voltage of several thousand volts is required in energizing the magnetron. In handling the microwave heating apparatus, an operator is often exposed to the serious danger of electrical shock if the magnetron is insufficiently electrically insulated. In addition, to obtain such a high tension voltage, a high tension voltage transformer with high KVA ratings is required, inevitably resulting in an extreme increase of the weight of the microwave heating apparatus. Recently, the microwave heating apparatus including a solid state oscillating circuit, which is operable at low voltage of several tens of volts, has been developed to overcome the above-mentioned high tension voltage problem. Generally, in this type of microwave heating apparatus, the solid state oscillating circuit generates only weak microwave energy. Thus, microwave heating apparatus needs amplifier circuits to intensify such weak microwave energy to a sufficient energy level. The inventors of this application, however, have found the following problems.

Impedance mismatching occurs between the solid state oscillating circuit and the amplifier circuits when the heating operation is started, because, when the voltage of a power supply source is provided and the solid state oscillating circuit start generating microwave energy, the amplifier circuits has not been in a stable state. As a result of the impedance mismatching, the microwave generated by the solid state oscillating circuit is reflected from the amplifiers possibly destroys the solid state oscillating element and the amplifying transistors in the amplifiers. To put the microwave heating apparatus with the solid state oscillating circuit to practical use; firstly, the above disadvantage should be overcome and, secondly, some heat protection is required for the solid state oscillating circuit and amplifier circuits. Specifically, it is necessary to dissipate effectively the heat generated by the amplifier circuits. Toward this end, careful consideration should be given to the arrangements of the solid state oscillating circuit and the amplifier circuits in the microwave heating apparatus.

SUMMARY OF THE INVENTION

Accordingly, a primary object of the present invention is to provide a microwave heating apparatus which can operate effectively, while protecting a solid state oscillating circuit and amplifier circuits for amplifying the output of the oscillating circuit from malfunction due to the reflecting microwave energy and/or a rise in temperature.

A microwave heating apparatus with solid state microwave oscillating device according to one aspect of the present invention comprises, a heating chamber, a solid state oscillating circuit, amplifier circuits for amplifying the microwave energy generated by said solid state oscillating circuit, a device for transmitting to said heating chamber the microwave energy amplified by said amplifier circuits, a first power source for energizing said solid state oscillating circuit, a second power source for energizing said amplifier circuits, a starting device for causing the heating operation of said heating chamber to start, and a control circuit for activating said first power supply source after said second power supply source has been activated and said amplifier circuits have been in a stable state, in response to the operation of said starting device.

A microwave heating apparatus with solid state microwave oscillating device according to another aspect of the present invention comprises, a heating chamber having a top wall, a bottom wall, a rear wall and side walls, a solid state oscillating circuit, a microwave branching circuit for distributing the microwave energy generated by said solid state oscillating circuit to a plurality of branched output transmission lines, a plurality of amplifier modules, each of which is coupled at the input to the output transmission line of said microwave branching circuit, a microwave coupling circuit for combining the microwave energy supplied from the amplifier modules, a device for transmitting an output microwave energy from said microwave coupling circuit to said heating chamber, a first power supply source for energizing said solid state oscillating circuit, a second power supply source for energizing said amplifier modules, a starting device for causing the heating operation of said heating chamber to start, and a control circuit for activating said first power supply source after said second power supply source has been activated and said amplifier modules have been in a stable state in response to the operation of said starting device, wherein said microwave branching circuit is so disposed as to face said bottom wall of said heating chamber, and said amplifier modules are so disposed as to face said rear wall of said heating chamber and/or at least one of said side walls of said heating chamber.

DETAILED DESCRIPTION OF THE PREFERRED EMBODIMENTS

Figure 1:
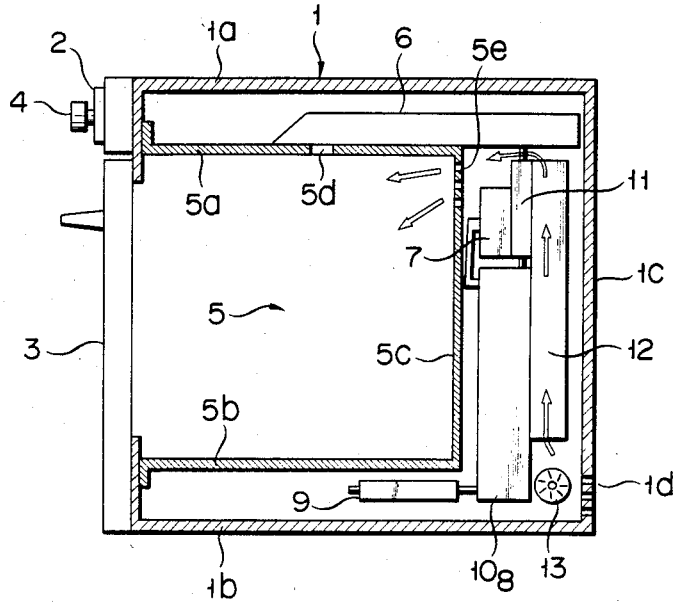
FIG. 1 shows a vertical sectional view of a microwave heating apparatus according to this invention.
Figure 2:
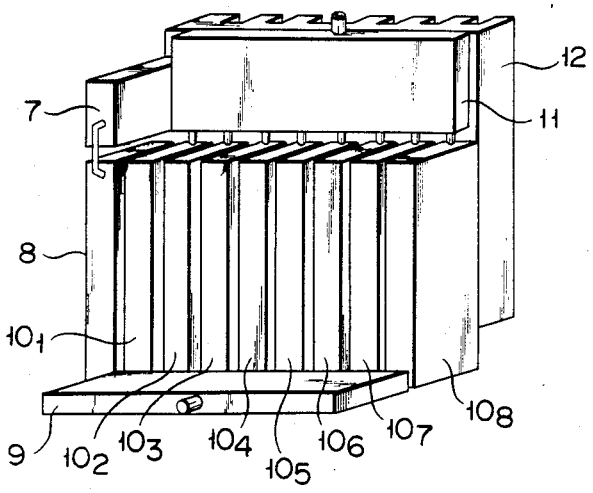
FIG. 2 shows a partial perspective view of the microwave heating apparatus shown in FIG. 1.

In FIGS. 1 and 2, a main frame 1 is provided, at the front portion, with a control panel 2 and a pivotably mounted front door 3. A cooking start switch 4 is mounted on the control panel 2. A heating chamber 5 is provided within the main frame 1, which has a top wall 5*a*, a bottom wall 5*b*, a rear wall 5*c*, and side walls (not shown). The front opening of the heating chamber 5 confronts the door 3. The top wall 5*a*, the bottom wall 5*b*, the real wall 5*c* and the side walls of the heating chamber 5 define corresponding space with respect to a top wall 1*a*, a bottom wall 1*b*, a rear wall 1*c* and side walls of the main frame 1, respectively. A microwave energy input opening 5*d* is formed in the top wall 5*a* of the heating chamber 5. The microwave energy input opening 5*d* is coupled to the output terminal of a wave guide 6 provided in the space defined by the top walls 1*a* and 5*a*. Disposed within the space defined by the rear wall 5*c* of the heating chamber 5 and the rear wall 1*c* of the main frame 1 are a solid state oscillating circuit 7, a pre-amplifier module 8, a plurality of amplifier modules $10_1$ to $10_8$, a microwave coupling device 11 and a cooling member 12. A cooling fan 13 is disposed under the cooling member 12. A microwave branching device 9 is disposed within the space defined by the bottom wall 5*b* of the heating chamber 5 and the bottom wall 1*b* of the main frame 1. The preamplifier module 8 and the amplifier modules $10_1$ to $10_8$ are arranged in this order, being equidistantly spaced side by side in the horizontal direction and in the vertical state. The rear side faces of the amplifier modules $10_1$ to $10_8$ are attached to one of the side faces of the cooling member 12 or heat absorbing member, while securing a thermal contact therebetween. The upper portion of the side face of the cooling member 12 is like wise attached to a side surface of the microwave coupling device 11, while securing a thermal contact therebetween. The solid state oscillating circuit 7 is disposed above the pre-amplifier module 8. The cooling fan 13 sucks air into the space from the outside through an air inlet hole 1*d* formed in the rear wall 1*c* of the main frame 1, provides cooling air to the cooling member 12, and sends the cooling air into the heating chamber 5 through an air intake hole 5*e* thereof. The air is discharged through air ventilation holes (not shown) provided through side walls of the heating chamber and main frame.

Figure 3:
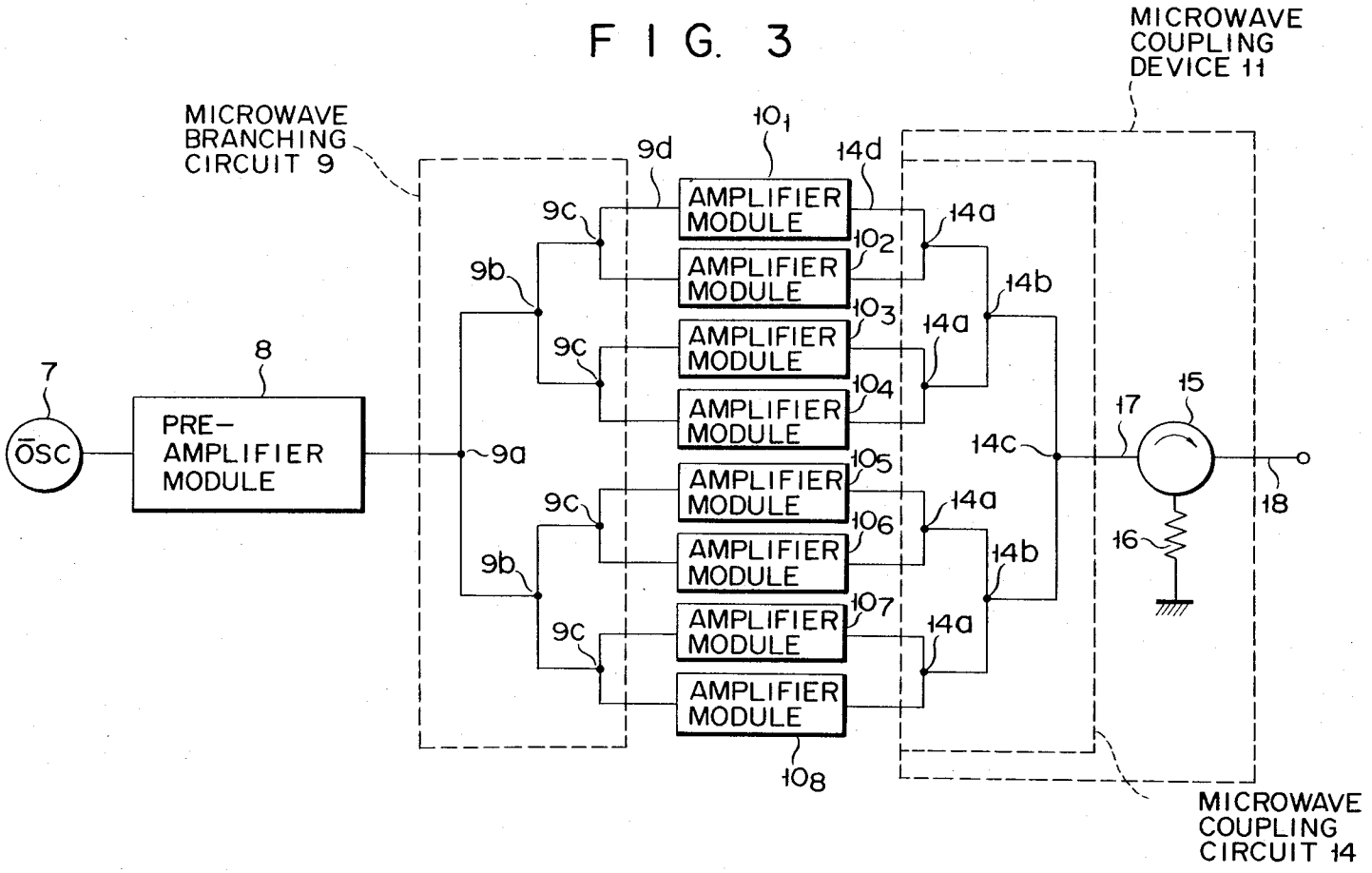
FIG. 3 is a schematic of a coupling relationship between the parts shown in FIG. 2.

A block diagram of the microwave generation system is illustrated in FIG. 3. The solid state oscillating circuit 7 contains a solid state oscillating semiconductor element (not shown) and oscillates at 2450 MHz, for example. The pre-amplifier module 8 amplifies the microwave energy of 2450 MHz. The microwave branching circuit 9 is a conventional tree network for distributing microwave energy derived from the pre-amplifier module 8 to the amplifier modules $10_1$ to $10_8$ wherein a pair of microwave transmission lines are connected at first 3dB branching junction point 9*a*, second 3dB branching junction points 9*b* and third 3dB branching junction points 9*c*, respectively. The incoming microwave energy is progressively halved at each branching junction point. Therefore, the microwave energy distributed to each of microwave transmission lines 9*d* is $\frac{1}{8}$ of the microwave energy supplied from the pre-amplifier module 8. Each of the amplifier modules $10_1$ to $10_8$ amplifies the microwave energy coupled through a corresponding microwave transmission line 9*d*. The microwave coupling device 11 includes a microwave coupling circuit 14, a microwave circulator 15, and a resistor 16. The microwave coupling circuit 14 is dimensionally and structurally equal to the microwave branching circuit 9 so that the former has the advantage of compatibility with the latter.

Specifically, the microwave coupling circuit 14 comprises eight input microwave transmission 14*b*, for instance, which are connected to the amplifier modules $10_1$ to $10_8$, respectively, one output microwave transmission line 17 connected to the microwave circulator 15, and coupling junction points 14*a*, 14*b* and 14*c* to which a pair of the microwave transmission lines are respectively connected as shown in FIG. 3, so that it combines output microwave energy of the amplifier modules $10_1$ to $10_8$ and provides the resultant microwave energy to the microwave circulator 15. The circulator 15 transmit it to an output microwave transmission line 18 which, in turn, is coupled to an input end of the wave guide 6. A resistor 16 of the circulator 15 serves as a termination load for the reflecting microwave from the heating chamber 5 and absorbs the microwave reflected from the heating chamber 5. With the circulator 15, the amplifier modules $10_1$ to $10_8$ are protected from the reflected microwave energy.

Figure 4:
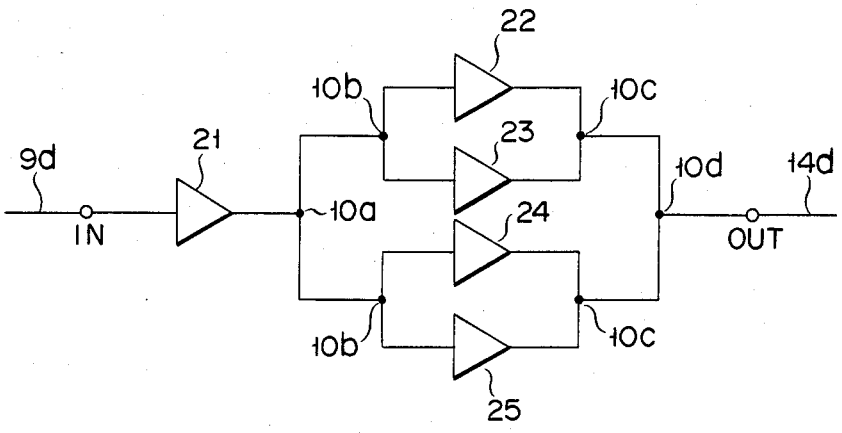
FIG. 4 is a block diagram of one of the amplifier modules shown in FIG. 1.
Figure 5:
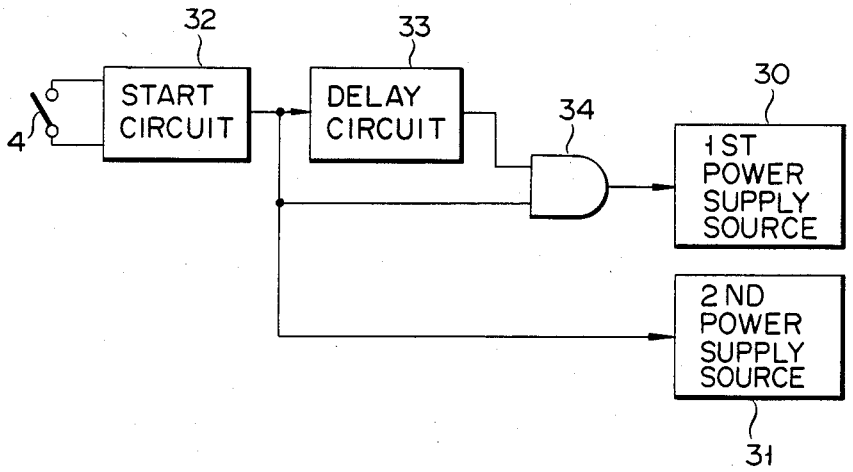
FIG. 5 is a block diagram of a control circuit for power supply sources actuating the parts shown in FIG. 3.

Pre-amplifier module 8 and each of amplifier modules $10_1$ to $10_8$ have the same circuit arrangements. The schematic arrangements of amplifier module $10_1$ is illustrated in FIG. 4, as a typical example. The amplifier module $10_1$ is composed of a single amplifier 21 of the first stage and four amplifiers 22 to 25 of the second stage. The amplifier module $10_1$ receives, at the input terminal IN, the microwave traveling along the microwave transmission line 9*d* of the microwave branching circuit 9, and amplifies the microwave. The amplified microwave is then applied to a first junction point 10*a*. The microwave energy is halved at the first junction point 10*a*, and one of the halves is applied to the corresponding second junction points 10*b*. In this way, the microwave energy quartered is applied to each of the second stage amplifiers 22 to 25. The microwave energy amplified by the amplifiers 22 to 25 are progressively added at the first coupling points 10*c* and second coupling point 10*d*, and the resultant microwave energy is given to the output terminal OUT of the amplifier module $10_1$. The resultant microwave energy is supplied to the microwave transmission line 14*d*. Shown in FIG. 5, is a block diagram of a control circuit used in controlling a first power supply source 30 for energizing the solid state oscillating circuit 7 and a second power supply source 31 for energizing the pre-amplifier module 8 and the amplifier modules $10_1$ to $10_8$. In FIG. 5, a start circuit 32 connected to the start switch 4 (FIG. 1) produces a logical signal indicative of "1" when the start switch 4 is closed. The start circuit 32 includes a flip-flop which is set by the logical "1" signal and reset by a signal supplied from a cooking timer circuit (not shown). The output terminal of the start circuit 32 is connected to the first input terminal of an AND circuit 34, via a delay circuit 33, and is directly connected to the second input terminal of the AND circuit 34 and the second power supply source 31, respectively. The output terminal of the AND circuit 34 is connected to the first power supply source 30.

The operation of the microwave heating apparatus thus constructed will be described hereinbelow. For cooking foodstuffs, the door 3 is opened, the foodstuffs is placed in the heating chamber 5, and the door 3 is closed. Then, an optimum cooking time for the foodstuffs is preset by a control device (not shown) mounted on the control panel 2, and the start switch 4 is turned on. Upon the turning-on of the start switch 4, a logical "1" signal is applied to the second power supply source 31 as an activating signal, thereby energizing the pre-amplifier module 8 and the amplifier modules $10_1$ to $10_8$. After a predetermined period of time elapses from the turning-on of the start switch 4, i.e., after the amplifier modules are energized, the delay circuit 33 produces a logical "1" signal to activate the first power supply source 30. Therefore, after a predetermined period of time has elapsed since the energization of the amplifier modules, the solid state oscillating circuit 7 is energized. The microwave energy from the solid state oscillating circuit 7 is amplified to a predetermined microwave energy level by the pre-amplifier module 8 and the amplifier modules $10_1$ to $10_8$. The amplified microwave energy is supplied to the heating chamber 5 through the wave guide 6, to effect a predetermined cooking operation. As a predetermined time elapses, the start circuit 32 produces a logical "0" signal which then de-energizes the first and second power supply sources 30 and 31.

As may be seen from the foregoing, sufficient microwave energy to heat the foodstuffs is obtained by means of driving the solid state oscillating circuit in conjunction with the amplifier modules at a level of several tens of volts. This feature almost perfectly eliminates the danger of electrical shock and remarkably reduces the weight of the microwave heating apparatus.

The provision of the control circuit shown in FIG. 5 protects the solid state oscillating semiconductor element included in the solid state oscillating circuit 7 and the transistors included in the amplifier modules 8 and $\mathbf{10}_1$ to $\mathbf{10}_8$ from destruction. To be specific, the amplifier modules 8 and $\mathbf{10}_1$ to $\mathbf{10}_8$ first energized by the second power supply source 31 and, after the amplifier modules settle down to a stable state, the solid state oscillating circuit 7 is energized by the first power supply source 31, as a second step. Introducing the time lag between energization of the oscillating circuit and the amplifier modules may successively solve the problem arising from impedance mismatching between the oscillating circuit 7 and the amplifier modules. This effect is very significant, particularly in the case where the load condition of the circuit of FIG. 3 changes in relation to kinds and amounts of foodstuffs involved.

In addition, the reflecting wave from the heating chamber 5 is absorbed by the resistor 16 in the above-mentioned embodiment. This feature further protects the transistors used in the amplifier modules from the reflecting microwave energy from heating chamber.

The amplifier modules $\mathbf{10}_1$ to $\mathbf{10}_8$ are primarily designed to provide in-phase microwave energy in order to effectively couple the same to the heating chamber 5 through the microwave coupling circuit 11. Toward this end, those amplifier modules $\mathbf{10}_1$ to $\mathbf{10}_8$ are formed in such a way as to be same in their electrical and structural configurations. Further, since, as mentioned hereinabove, the microwave branching circuit 9 and the microwave coupling circuit 14 are provided with the same circuit configuration but the microwave branching circuit 9 distributes an input microwave energy to the output transmission lines while the microwave coupling circuit 14 combines a plurality of input microwave energy with each other and supplies combined output microwave energy to the output transmission line, the microwave coupling circuit 14 compensates the output microwave energy for a phase shift caused by the microwave distributing circuit 9. Accordingly, the pre-amplifier module 8, the amplifier modules $\mathbf{10}_1$ to $\mathbf{10}_8$, and the microwave branching circuit 9, microwave coupling circuit 14, as a whole, are so arranged as to provide in-phase microwaves energy to the microwave circulator 15.

As shown in FIG. 2, a cooling member 12 is provided to dissipate the heat transferred from the pre-amplifier module 8, the amplifier modules $\mathbf{10}_1$ to $\mathbf{10}_8$, and the coupling circuit 11 so that high efficiency operation of the microwave oven may be assured. The heat dissipation is also quite important, since the transistors used in the amplifier modules are fragile when exposed to heat, compared to a magnetron. In the arrangement shown in FIGS. 1 and 2, the cooling member 12 not only may protect the transistor from thermally breaking down, but also may function as a supporting member for the preamplifier module 8, the amplifier module $\mathbf{10}_1$ to $\mathbf{10}_8$ and the coupling device 11. The solid state oscillating circuit 7 can be manufactured to be compact in size and light in weight. Therefore, the oscillating circuit 7 may be mounted in a position such as that shown in FIG. 2, thereby being effectively cooled.

The amplifier modules 8 and $\mathbf{10}_1$ to $\mathbf{10}_8$, both of which have a large heat generation, are equidistantly arranged in the space defined by the rear wall 5*c* of the heating chamber 5 and the rear wall 1*c* of the main frame 1. Such arrangement of the amplifier modules makes ingenious use of the convection of the cooling air and, further, provides for effective utilization of the space. This leads to improvement of the cooling efficiency of the amplifier modules and size reduction of the microwave heating apparatus.

The microwave branching circuit 9 on the other hand has a relatively small amount of generated heat. Accordingly, this component 9 may be placed in the space defined by the bottom wall 5*b* of the heating chamber 5 and the bottom wall 1*b* of the main frame.

The hot air stream passing through the cooling member 12 enters the heating chamber 5 to accelerate the heating of foodstuffs placed therein, and carries the vapor generated from the foodstuffs, from the heating chamber 5 to the outside of the main frame 1.

This invention is not limited to the embodiment described above. For example, the second power supply source 31 may be de-energized after the first power supply source is de-energized. Further, the amplifier modules 8 and $\mathbf{10}_1$ to $\mathbf{10}_8$ may be disposed in the space defined by a side wall of the main frame 1 and a side wall of the heating chamber 5; or, may be placed in the spaces defined by rear walls 5*c* and 1*c* and side walls of the heating chamber 5 and main frame 1.

What is claimed is:

1. A microwave heating apparatus with solid state microwave oscillating device comprising:

a heating chamber;

a solid state oscillating circuit for generating microwave energy;

amplifier circuit means for amplifying the microwave energy generated by said solid state oscillating circuit;

means for transmitting to said heating chamber the microwave energy amplified by said amplifier circuit means;

a first power source for energizing said solid state oscillating circuit;

a second power source for energizing said amplifier circuit means;

starting means for causing the heating operation of said heating chamber to start; and control means for activating said first power supply source only after said second power supply source has been activated and said amplifier means has been in a stable state, in response to the operation of said starting means.

2. A microwave heating apparatus according to claim 1, wherein said control means comprises:

a time delay circuit for receiving a start signal from said starting means, to delay said starting signal by a predetermined period of time; and an AND circuit receiving, at a first input thereof, the delayed starting signal from said time delay circuit, and, at a second input thereof, said starting signal from said starting means, for activating said first power supply source, said starting signal from said starting means being supplied to said second power source to activate the same.

3. A microwave heating apparatus with solid state microwave oscillating device comprising:

a heating chamber having a top wall, a bottom wall, a rear wall and side walls;

a solid state oscillating circuit for generating microwave energy;

microwave branching means for distributing the microwave energy generated by said solid state oscillating circuit to a plurality of branched output transmission lines;

a plurality of amplifier modules, each of which is coupled at the input to the output transmission line of said microwave branching means;

microwave coupling means for combining the microwave energy supplied from the amplifier modules;

means for transmitting an output microwave energy from said microwave coupling means to said heating chamber;

a first power supply source for energizing said solid state oscillating circuit;

a second power supply source for energizing said amplifier modules;

starting means for causing the heating operation of said heating chamber to start; and control means for activating said first power supply source only after said second power supply source has been activated and said amplifier modules have been in a stable state, in response to the operation of said starting means; wherein said microwave branching means is so disposed as to face said bottom wall of said heating chamber, and said amplifier modules are so disposed as to face said rear wall of said heating chamber and/or at least one of said side walls of said heating chamber.

4. A microwave heating apparatus according to claim 3, wherein said microwave heating apparatus further comprises:

a main frame which includes a top wall defining a space with respect to the top wall of said heating chamber, a bottom wall defining a space with respect to the bottom wall of said heating chamber, a rear wall defining a space with respect to the rear wall of said heating chamber, side walls defining a space with respect to the respective side walls of said heating chamber, and a door facing the opening of said heating chamber; and, a pre-amplifier module connected between said solid state oscillating circuit and said microwave branching means;

said pre-amplifier module and said amplifier modules connected between said branching means and said coupling means being disposed with an equal space therebetween, in either the space defined between the rear walls and/or the space defined between one of side walls of said heating chamber and said main frame.

5. A microwave heating apparatus according to claim 4, wherein said microwave heating apparatus further comprises:

a heat dissipating member which is brought into contact with said amplifier modules and said pre-amplifier module; and forced cooling means provided in the space below said heat dissipating member for forcibly cooling said heat dissipating member.

6. A microwave heating apparatus according to claim 4, wherein:

said microwave branching means includes substantially the same tree network as that of said microwave coupling means.

7. A microwave heating apparatus according to claim 3, wherein:

said coupling means includes a microwave circulator and a tree network having a plurality of input microwave transmission lines each of which is connected to said amplifier modules and an output microwave transmission line connected to said circulator, said circulator providing an output microwave energy from said output microwave transmission line to said microwave transmitting means and having a terminal connected to a terminating resistor for absorbing a reflected microwave energy from said heating chamber.

* * * * *